United States Patent [19]

Brashear

[11] 4,063,440

[45] Dec. 20, 1977

[54] QUICK-CHANGE COILER ASSEMBLY FOR STRIP MILLS AND THE LIKE

[75] Inventor: Joseph O. Brashear, Glenshaw, Pa.

[73] Assignee: Mesta Machine Company, Pittsburgh, Pa.

[21] Appl. No.: 677,703

[22] Filed: Apr. 16, 1976

[51] Int. Cl.[2] ..... B21C 47/06

[52] U.S. Cl. ..... 72/148; 242/78.1

[58] Field of Search ..... 72/146, 147, 148, 236; 242/78.1, 80

[56] References Cited

U.S. PATENT DOCUMENTS

| | | | |
|---|---|---|---|
| 3,100,605 | 8/1963 | Bond | 242/80 |
| 3,240,043 | 3/1966 | Sieger | 242/78.1 X |
| 3,294,338 | 12/1966 | O'Brien | 242/78.1 |
| 3,304,023 | 2/1967 | O'Brien | 242/80 |
| 3,406,552 | 10/1968 | Krauss et al. | 72/236 |
| 3,646,790 | 3/1972 | Properzi | 72/236 X |
| 3,699,791 | 10/1972 | Eibe | 72/236 X |

FOREIGN PATENT DOCUMENTS

| | | | |
|---|---|---|---|
| 1,280,294 | 2/1961 | France | 242/78.1 |
| 2,420,567 | 12/1974 | Germany | 242/78.1 |

*Primary Examiner*—E. M. Combs

*Attorney, Agent, or Firm*—Smith and Carothers

[57] ABSTRACT

A prepackaged coiler assembly is disclosed and includes a housing, a plurality of wrapper rolls, a support for each of the wrapper rolls movably mounted on the housing, and motive hold-downs coupled to each of the supports and mounted on the housing. The motive hold-downs are disposed for urging the supports and the rolls toward a mandrel mounted independently and centrally of the wrapper rolls and for withdrawing the supports and rolls from the mandrel and from a strip coil thereon to permit ejection of the coil through a side opening in the housing. At least one of the motive hold-downs is disposed for withdrawing the associated wrapper roll and support to a further withdrawn position to permit lifting of the prepackaged assembly over the mandrel. The housing is provided with a bottom opening for passage of the mandrel therethrough.

11 Claims, 4 Drawing Figures

QUICK-CHANGE COILER ASSEMBLY FOR STRIP MILLS AND THE LIKE

The present invention relates to a coiler assembly for rewinding the product of a strip mill and the like, and more particularly to an improved coiler assembly of the character described which is integrated with various accessories and subassemblies into a pre-packaged unit capable of quick-changing for replacement or maintenance purposes.

Until the advent of the present invention, the coilers employed with strip mills and the like, particularly hot strip mills, have been a production bottleneck. Many strip mills operate with strip speeds in the neighborhood of 5,000 feet per minute such that any stoppage or slowdown at the coiler (or any other location along the length of the mill) results in tremendous production losses.

Generally there are two or three coilers at the end of a modern strip mill, of which two must be on line at all times for efficient operation. Coilers of known construction cannot be adequately maintained or serviced on line owing to space limitations and production requirements. On the other hand, removal of a conventional coiler is very difficult, owing again to space limitations and the necessity for disrupting a large number of utility interconnections, retraction of accessory equipment and so on. Following these operations, a direct crane lift still could not be executed owing to the location of the pinch rolls, table rolls and side guides. It was also necessary to remove the mandrel, coil stripping device and related loop systems. There has been little incentive for withdrawing the coiler from the line for normal maintenance and service, as only limited additional maintenance and service was possible without complete disassembly of the equipment.

In consequence, although coilers absorb a tremendous amount of abuse during production runs, the coilers have been the last to be maintained or serviced, except when absolutely necessary and virtually never on a routine basis.

In the absence of proper maintenance and service, the coiler rapidly lost its ability to maintain a tight coil and particularly to prevent telescoping thereof when the mill is zoomed or slowed down at the tail and head ends of the coil.

The present invention overcomes these difficulties by incorporating the coiler and its immediate machinery such as the wrapper rolls, motive hold-downs, coil stripping device, loop systems, together with the many utility interconnections and accessory equipment such as pinch rolls, table rolls and side guides into a prepackaged equipment assembly constituting the entire coiler arrangement save for the mandrel coil stripping device and associated components. A housing for the prepackaged assembly is arranged for engagement with a prepared platform or foundation such that a quick-connection of all utilities and service lines is effected automatically when the prepackaged coiler assembly is installed or removed relative to its location on line. by integrating various coiler accessories such as pinch rolls, table rolls and/or side guides with the prepackaged coiler assembly, a direct crane lift can be executed during installation or removal of the coiler assembly.

In consequence prior removal of the mandrel, coil stripping device and related loop systems is unexpectedly eliminated. In the past, removal of these systems has made withdrawal of conventional coiler arrangements a most time-consuming operation.

The prepackaged coiler of the invention is arranged for non-bolted, automatic connection and disconnection of the various utilities such as water, air, and electric to wrapper roll hold-downs, solenoids, roll drives, etc. To effect a quick-change of the prepackaged coiler assembly, in a typical application, it is only necessary to disconnect the pinch and blocker roll drive spindles, to uncouple any pilot air lines, and to remove the housing hold-down bolts. The prepackaged coiler then can be direct-lifted free of its environs for reconditioning, maintenance or service in the shop or other remote locations. However, all components of the prepackaged coiler arrangement are readily accessible for normal, on-line maintenance and service.

The coiler arrangement of the invention in addition permits the housing therefor to be serviced, in many cases without removal of the prepackaged assembly. This is made possible by the elimination of external utility runs. Elimination of these runs in fact permits many maintenance and service operations to be performed on various subassemblies of the prepackaged equipment in situ. The preponderant portion of the utility runs are conducted through the housing itself. Most importantly, as noted previously it is no longer necessary to decouple the coiler mandrel or mandrel drive during the quick-change operation.

The foregoing advantageous ends are attained in an unexpected manner by providing a prepackaged coiler assembly comprising a housing, a plurality of wrapper rolls, a support for each of said wrapper rolls movably mounted on said housing, motive hold-down means coupled to each of said supports and mounted on said housing, said motive means being disposed for urging said support and said rolls toward a mandrel mounted independently and centrally of said wrapper rolls and for withdrawing said supports and rolls from said mandrel and from a strip coil thereon to permit ejection of said coil through a side opening in said housing, at least one of said motive means being disposed for withdrawing the associated wrapper roll and support to a further withdrawn position to permit lifting of said prepackaged assembly over said mandrel, said housing having a bottom opening for passage of said mandrel therethrough.

There is also provided a housing for a prepackaged equipment assembly and the like, said housing including at least one utility conduit mounted therein, said utility conduit terminating in a disconnect component mounted on a bottom wall of said housing, a complementary disconnect component mounted on a stationary foundation for said housing in alignment with the first-mentioned disconnect component at an installed position of said housing on said foundation, said disconnect component being connected and severed upon vertical movement of said housing relative to said foundation.

There is also desirably provided a similar pre-packaged coiler assembly wherein a number of automatic utility disconnects are similarly mounted on said housing and on said foundation, and a like number of electric and fluid conduits are mounted within said housing and are coupled respectively to said disconnects.

There is also provided in a quick-change equipment housing and foundation therefor, the combination comprising at least one fluid channel within said foundation and terminating in an outlet opening in a generally horizontal supporting surface of said foundation, a complementary conduit mounted in said housing and terminating in a similarly disposed opening in a bottom wall of said housing, said openings being aligned at a predetermined installed position of said housing on said foundation, and pressure sensitive sealing means surrounding said openings and actuated by engagement between said foundation and said housing bottom wall.

Applicant is aware of the following U.S. Pat. Nos.: J. W. O'Brien — 3,304.023; J. W. O'Brien et al. — 3,294,338; H. L. F. Bond — 3,100,605; J. W. O'Brien et al. — 3,062,470.

The foregoing references do not disclose the points of novelty set forth above and elsewhere in the application.

During the foregoing discussion, various objectives, features and advantages of the invention have been set forth. These and other objectives, features and advantages of the invention together with structural details thereof will be elaborated during the forthcoming description of certain presently preferred embodiments of the invention and presently preferred methods of practicing the same.

In the accompanying drawings there are illustrated certain presently preferred embodiments of the invention together with certain presently preferred methods of practicing the same wherein.

Figure 1:
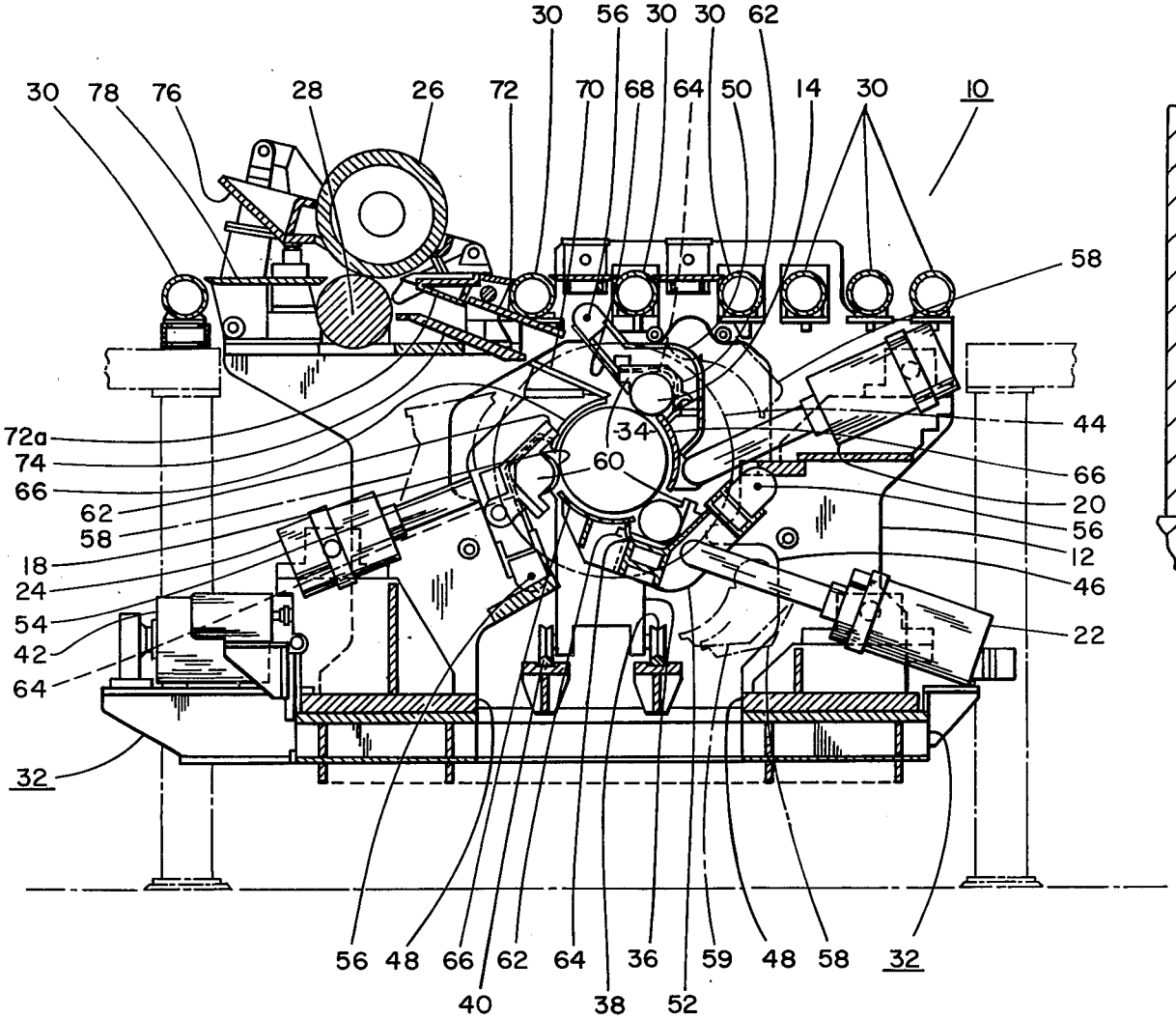
FIG. 1 is a longitudinally sectioned view of one form of prepackaged coiler assembly arranged in accordance with the invention.

With reference now more particularly to the drawings, principally to FIG. 1, a prepackaged coiler assembly 10 shown therein includes a removable and direct-liftable housing 12, wrapper rolls 14, 16, 18, motive hold-down means such as cylinders 20, 22, 24, pinch rolls 26, 28, table rollers 30, and associated components. The aforementioned equipment is mounted more or less permanently on the housing 12 for removal therewith as a prepackaged unit. The housing 12 is installed on foundation 32, from which it can be removed with a minimum of labor. The housing 12 and foundation 32 contain components of automatic utility disconnects, all of which are described below in connection with FIGS. 2–4 of the drawings.

A coil mandrel 34 is mounted amongst the wrapper rolls 14-18 and stationary on the foundation 32. The stripping device 36 is provided with trunnion wheels 38 cooperating with rails 40 mounted on the foundation 32. The stripping device 36 is driven transversely of the strip path along rails 40 by coil ejector drive 42 and associated drive linkages of conventional construction.

To permit the aforementioned transverse movements of the stripping device and a strip coil which may have a maximum diameter denoted generally by chain line 44, the housing 12 is provided with a relatively large, left side opening 46. The side opening 46 is irregular in shape in order to provide mounting points for components associated with the wrapper rolls 14–18. The side opening 46 cooperates with floor opening 48 in order to permit removal of the housing 12, together with wrapper rolls 14–18, pinch rolls 26, 28 and other components mounted on the housing 12 without disturbing the mandrel 34, and associated components including the coil ejector 36 and drive 42 mounted on the foundation 32.

In the event of requirements for major maintenance or servicing, for the wrapper rolls 14–18, their drive cylinders 20–24, pinch rolls 26, 28 or their associated components mounted as aforesaid on the housing 12, the entire prepackaged coiler assembly 10 can be unexpectedly removed without the burdensome necessity of decoupling the mandrel 34, the mandrel drive (not shown) or the coil ejector 36 and drive 42, or the necessity of breaking the great many utility connections of conventional coilers. A similar prepackaged assembly 10, having a cooperating side and bottom openings 46, 48 can then be dropped over the mandrel 34 and associated components located on foundation 32 for resumption of production with minimal down time. The withdrawn assembly 10 then can be serviced in the shop or at other convenient location in the mill.

To facilitate removal of the prepackaged assembly housing 12 with the components mounted thereon, the wrapper rolls 14–18, together with their supporting brackets 50–54 which are pivotally secured at points 56 to inside wall surfaces of the housing 12, are withdrawn to their chain-outline positions denoted generally by reference numerals 58, 59. The wrapper rolls 14–18, when thus withdrawn by their hold down cylinders 20–24, provide an unobstructed passage adjacent the housing openings 46, 48 for the mandrel 34 and its carriage 36 when the housing 12 is lifted.

By withdrawing the wrapper rolls 14–18 and their supports 50–54 to their chain-outline positions 58, 59 clearance is provided for the normal ejection of the strip coil 54 through the side opening 46 of the housing 12. At least one of the hold-down cylinders, for example the cylinder 22 is capable of pivoting the associated support 52 to a further withdrawn position, denoted by its chain-outline 59, such that the support 52 then does not interfere with passage of the mandrel 34 and associated components through the housing bottom opening 48 when the latter is being removed or installed.

The wrapper rolls 14–18 are rotatably mounted on their respective supports 50–54 by means of angle brackets 60 bolted to cradles 62 forming part of the respective supports 50–54. The supports 50–54 can be provided with coolant and/or lubricant passages 64. Use of the angular roll mounting brackets 60, instead of the conventional U-bolts, facilitates maintenance of the wrapper rolls 14–18 and their supports 50–54.

Mounted on each of the wrapper roll supports 50–54 is an arcuate strip guide 66. The strip guides 66, in the inmost positions of the wrapper rolls 14–18, are stepped progressively closer to the mandrel 34 to facilitate feeding the leading edge of the strip onto the mandrel. In addition, a pair of funnel-type entry guides 68, 70 are mounted respectively on the wrapper roll supports 50–54. The entry guides 68, 70 cooperate with delivery guides 72, 74 also mounted on the housing 12 for the pinch rolls 26, 28, for delivering the strip from the pinch rolls 26, 28 to the mandrel 34. As the wraps of strip build up upon the coil mandrel 34 the wrapper rolls 14–18 are of course forced outwardly against the action of the hold-down cylinders 20–24.

A pair of entry guides 76, 78, also mounted on the removable housing 12 and in this example forming part of the prepackaged coiler assembly 10, cooperate with one or more of the table rollers 30 in delivering strip to the pinch rolls 26, 28.

The portion of the roll table 30 following the pinch rolls 26, 28 is employed to guide the strip to a succeeding or second coiler arrangement (not shown) while the strip coil 44 is being ejected from the first coiler arrangement 10. A pivoted strip guide segment 72*a*, also mounted on the housing 12, is employed for deflecting the strip either between the delivery guides 72, 74 or farther along the roll table 30.

Figure 2:
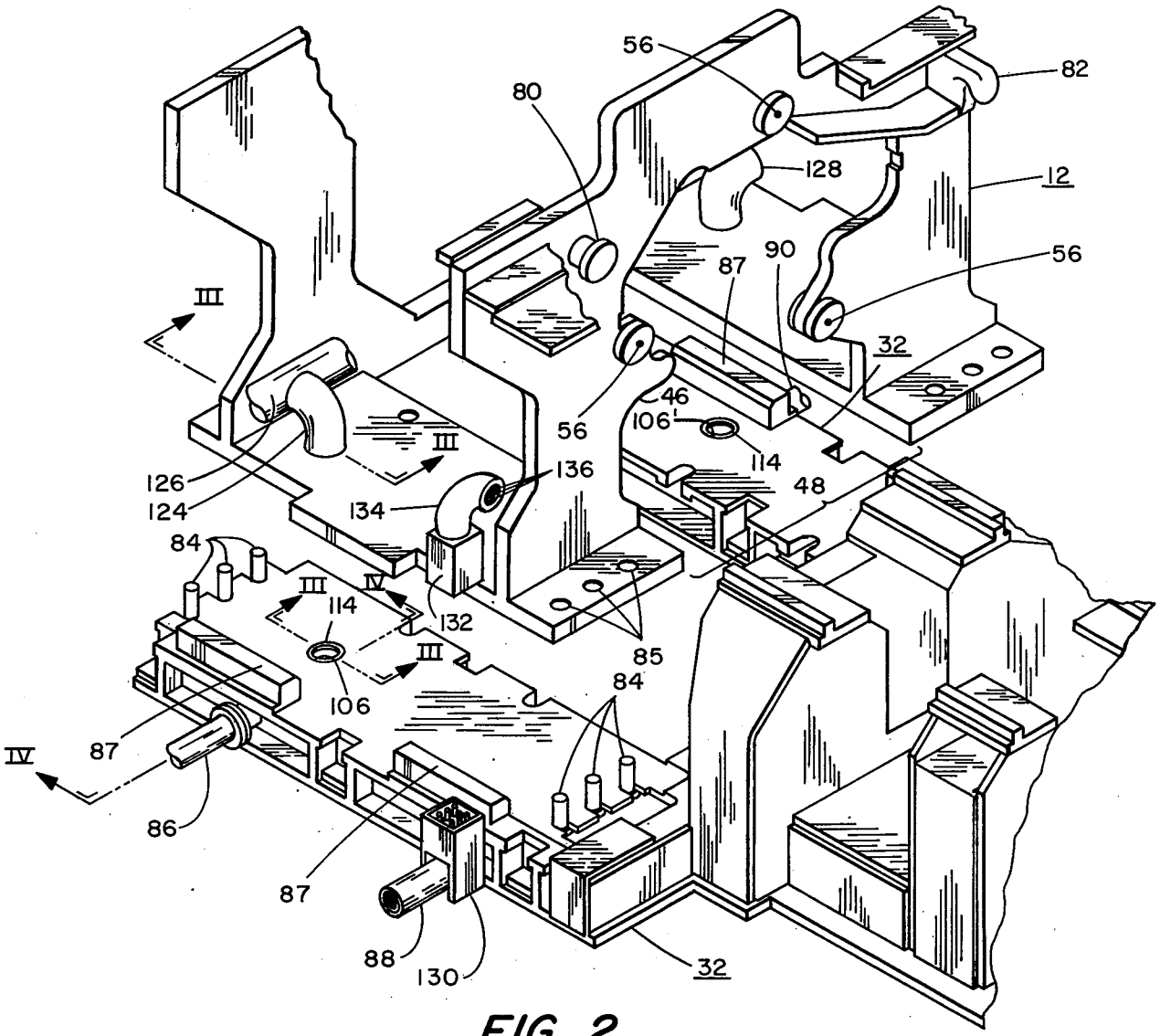
FIG. 2 is a partially exploded isometric view of the housing and foundation arrangement shown in FIG. 1 and taken generally from the left side and delivery end thereof.

As better shown in FIG. 2 the housing 12, in this example of the invention, is provided with a number of reenforced areas for the pivot points 56 of the wrapper roll supports 50–54. Also mounted on the outer wall surfaces of the housing 12 are a number of lifting hooks 80, 82 for the attachment of slings for lifting the housing 12 and the components mounted thereon for unexpectedly quick, coiler-changing operations.

When in place, the housing 12 is secured to its foundation 32 by a number of mounting bolts 84. Desirably the mounting bolts are elongated above the adjacent portions of the foundation 32 and floor plate of the housing 12 thereby cooperating with foundation keys 87 to provide a lifting guide arrangement for the housing 12 during the initial and final few inches of lift or drop.

In order to endow the prepackaged assembly 10 and its housing 12 with the quick-change principle described previously, the housing 12 together with its foundation 32 is unexpectedly provided with a number of automatic utility disconnects. Use of these automatic utility disconnects not only avoids a spaghetti-like encumberance of the coiler assembly but also unexpectedly eliminates the enormous amount of labor heretofore required in making and breaking conventional utility connections during installation or changing of conventional coilers.

In FIG. 2, one arrangement is disclosed for providing the aforementioned automatic utility disconnects for air, water and electric services or the like which desirably are conducted to the stationary foundation 32 through appropriate conduits 86, 88, 90.

Figure 3:
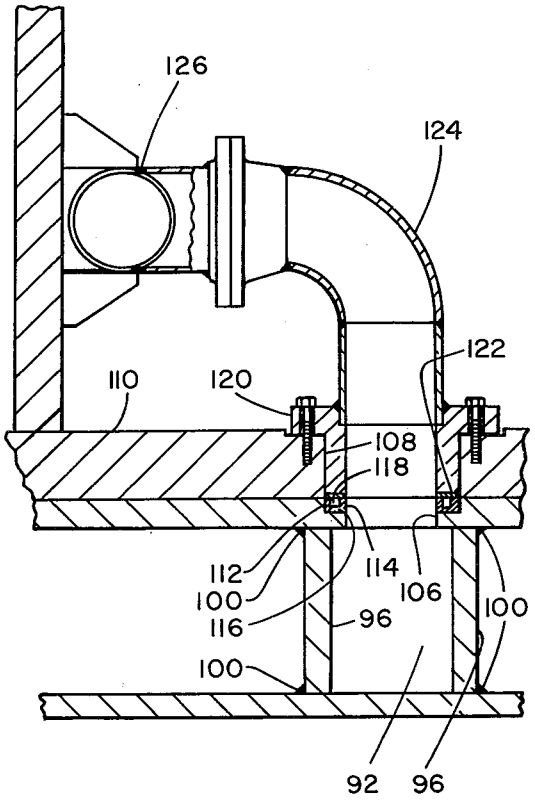
FIG. 3 is an enlarged, vertically sectioned view of one of the automatic utility disconnects of the aforesaid housing and taken along reference line III—III of FIG. 2.
Figure 4:
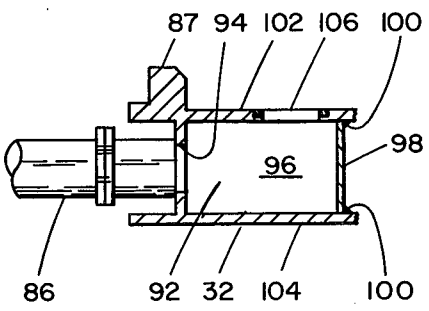
FIG. 4 is an enlarged, vertically sectioned view of the automatic utility disconnect in the foundation or base shown in FIG. 3 but taken along reference line IV—IV of FIG. 2.

With reference now to FIGS. 2–4 of the drawings a typical automatic utility disconnect according to the invention, will now be described. In a typical installation compressed air or other working fluid can be supplied to the foundation 32 through conduit 86. The conduit 86 communicates with an internal passageway 92 (FIGS. 3 and 4) through opening 94 in the foundation 32. The internal passage or channel 92 is formed in this example by a pair of side channel plates 96 and an end channel plate 98 all of which are seal-welded at 100 to upper and lower foundation plates 102, 104.

The automatic utility disconnect includes in this example a second opening 106 formed in the upper foundation plate 102 or other substantially horizontal portion of the foundation 32 in alignment with opening 108 in bottom wall 110 of the housing 12, when the latter is properly installed on the foundation 32. The foundation opening 106 is provided with an offset 112, as better shown in FIG. 3, which is filled with a compression seal 114. The compression seal can comprise a ring 116 made of a non-corrosive material having a groove therein filled with a compressible packing, O-ring or the like 118. Desirably the packing 118 projects slightly above the plane of the upper foundation plate 102 so that the packing is compressed when the housing 12 engages the foundation 32.

In this connection the housing opening 108 desirably has a bushing 120 inserted therethrough and provided at its bottom end with a contact ring 122 also desirably fabricated from a non-corrosive material. The contact ring 122 is thus disposed to engage the compression member 114 for compression and sealing of the packing material 118 contained therein. The offset 112 and the circumferential compression seal 114 in effect underlie an extension of the housing floor 110 for actuation thereby. Obviously the parts can be reversed such that the offset 112 and seal 114 can be provided in the housing opening or passage 108.

With this arrangement the automatic utility disconnect shown in FIG. 3 and related figures can be connected or severed as required without the necessity of manipulating any type of fastener. Suitable valves (not shown) can be coupled in the conduit 86 or in conduit 124 connected to the housing bushing 120. The conduit 124, which can be suitably branched as desired as denoted by reference numeral 126, is coupled in a typical installation to various air valves (not shown) associated with the aforedescribed components of the prepackaged assembly 10 which are mounted on the removable housing 12.

In the exemplary housing 12 shown in FIG. 2 water conduit 128 similarly is connectable through another housing (not shown) to foundation opening 106' which is similarly internally connected to water inlet conduit 90 of the foundation 32. The water conduit 128 is likewise coupled to various water valves (not shown) associated with the aforedescribed components.

The automatic electric disconnect of the prepackaged coiler assembly 10 includes a stationary jack 130 mounted on the foundation 32 and a complementary jack 132 mounted on the floor of the housing 12. The aforementioned electrical conduit 88 is permanently connected to the foundation jack 130, while an internal electrical conduit 134 similarly is permanently connected to the housing jack 132.

The aforementioned mounting bolts 84 are sufficiently elongated and cooperate with mounting bolt apertures 85 in the bottom wall 110 of the housing 12 to ensure proper engagement and disengagement of the jack components 130, 132 without damaging their contacts. In this respect the bolts 84 serve as vertical guideways during initial and final lifting movements of the housing.

Although the foundation jack 130 is shown as a male component and the jack 132 as a female component, obviously these components can be reversed. The several electrical leads 136 enclosed within the housing electrical conduit 134 are connected internally of the housing 12 to various motors, valve operators, and the like.

In the illustrated embodiment of the invention, it will be evident from FIG. 2 that the water, air and electric utilities can be connected or severed at only three locations at the junction of the housing 12 and its foundation 32. Moreover, such connection or severance is fully automatic save for manipulation of conventional shut-off valves or switches (not shown) as the case may be. More importantly, the time-consuming and laborious connection or severance of the very many individual air, water and electric lines is no longer necessary. The invention, therefore, actualizes the quick-changing concept in its application to coiler assemblies. As the mandrel 34, its carriage 36, and associated components are left in place when the prepackaged coiler component assembly 10 is removed, maintenance and servicing of all components of the coiler arrangement is unexpectedly facilitated to a marked degree.

From the foregoing it will be apparent that a novel and efficient Quick-Change Coiler Assembly For Strip Mills And The Like has been described herein. While I have shown and described certain presently preferred embodiments of the invention and have illustrated presently preferred methods of practicing the same it is to be distinctly understood that the invention is not limited thereto but may be otherwise variously embodied and practiced within the spirit and scope of the invention.

I claim:

1. A prepackaged coiler assembly comprising a foundation and a housing removeably mounted on said foundation; wherein said housing includes a plurality of wrapper rolls, a support for each of said wrapper rolls movably mounted on said housing, motive hold down means coupled to each of said supports and mounted on said housing; said motive means being disposed for urging said supports and said rolls toward a mandrel mounted on said foundation independently and centrally of said wrapper rolls and for withdrawing said supports and rolls from said mandrel and from a strip coil thereon to permit ejection of said coil through a side opening in said housing; at least one of said motive means being disposed for withdrawing the associated wrapper roll and support to a further withdrawn position for direct lifting of said prepackaged assembly from said foundation vertically past said mandrel with clearance; said housing having a bottom opening for passage of said mandrel therethrough.

2. The combination according to claim 1 including a number of table rolls mounted on a top portion of said housing.

3. The combination according to claim 1 including a pair of pinch rolls mounted at a top portion of said housing.

4. The combination according to claim 3 including a pair of entry guides for said pinch rolls mounted on a top portion of said housing, and a pair of delivery guides for said pinch rolls likewise mounted on said housing.

5. The combination according to claim 4 including a pair of entry guides for said wrapper rolls and said mandrel, said guides being mounted respectively on two of the wrapper roll supports.

6. The combination according to claim 1 including a plurality of automatic utility disconnects cooperatively mounted on said housing and on said foundation.

7. The combination according to claim 6 including at least one automatic fluid disconnect, said fluid disconnect including fluid passage means extending through said foundation and terminating in a foundation opening aligned with a housing passage in a bottom wall thereof when said housing is positioned on said foundation, a supply conduit coupled to said fluid passage means, a second conduit coupled to said housing at said housing passage and to fluid-utilizing equipment mounted on said housing, and a pressure sensitive sealing arrangement mounted on at least one of said housing and said foundation adjacent said foundation opening and said housing passage.

8. The combination according to claim 6 including at least one automatic electric disconnect, said electric disconnect including jack components mounted respectively on said foundation and on said housing at aligned positions, said jack components being aligned and electrically engaged upon installation of said housing on said foundation.

9. The combination according to claim 8 wherein said jack members are disposed for connection or severance upon vertical movement of said housing relative to said foundation.

10. The combination according to claim 6 including a plurality of elongated mounting bolts extending vertically from said foundation for cooperation with mounting apertures in the bottom of said housing, said bolts being sufficiently elongated to guide vertical movements of said housing in cooperation with keys in the foundation during initial and final movements thereof to ensure proper engagement and disengagement of said utility disconnects.

11. The combination according to claim 1 wherein said housing bottom opening communicates with said housing side opening.

* * * * *